US009459070B2

(12) United States Patent
Camille

(10) Patent No.: US 9,459,070 B2
(45) Date of Patent: Oct. 4, 2016

(54) CAM GUARD APPARATUS

(71) Applicant: Ronald Camille, Riverton, IL (US)

(72) Inventor: Ronald Camille, Riverton, IL (US)

( * ) Notice: Subject to any disclaimer, the term of this patent is extended or adjusted under 35 U.S.C. 154(b) by 0 days.

(21) Appl. No.: 14/841,618

(22) Filed: Aug. 31, 2015

(65) Prior Publication Data

US 2016/0084608 A1 Mar. 24, 2016

Related U.S. Application Data

(60) Provisional application No. 62/053,715, filed on Sep. 22, 2014.

(51) Int. Cl.
*F41B 5/10* (2006.01)
*F41B 5/14* (2006.01)

(52) U.S. Cl.
CPC *F41B 5/148* (2013.01); *F41B 5/10* (2013.01)

(58) Field of Classification Search
CPC ..... F41B 5/10; F41B 5/105; F41B 5/14
See application file for complete search history.

(56) References Cited

U.S. PATENT DOCUMENTS

| | | | | |
|---|---|---|---|---|
| 4,979,488 | A * | 12/1990 | Fenton | F41B 5/10 124/25.6 |
| 6,216,680 | B1 * | 4/2001 | Sanders | F41B 5/14 124/86 |
| D530,387 | S | 10/2006 | Kennedy | |
| D568,435 | S | 5/2008 | Delprete | |
| 7,730,883 | B2 | 6/2010 | Lawson et al. | |
| 8,544,456 | B2 * | 10/2013 | Grace | F41B 5/10 124/23.1 |
| 8,671,924 | B2 * | 3/2014 | Hpward | F41B 5/105 124/25.6 |

* cited by examiner

*Primary Examiner* — John Ricci
(74) *Attorney, Agent, or Firm* — Law Office of Robert M. Patino

(57) ABSTRACT

A cam guard system that employs a cam guard apparatus for use on a compound bow to protect a cam of the compound bow. The cam guard apparatus has a C-shaped, rigid support member with a substantially flat connection portion, a concave extension portion, and a substantially flat resting portion. A means of securing the cam to the compound bow is also provided. The cam guard system employs a draw stop peg on an outside surface of the cam.

6 Claims, 3 Drawing Sheets

CAM GUARD APPARATUS

CROSS-REFERENCE TO RELATED APPLICATION

This application claims the benefit of U.S. Provisional Patent Application No. 62/053,715, filed Sep. 22, 2014, the entire disclosure of which is incorporated herein by reference.

BACKGROUND OF THE INVENTION

The present invention is in the technical field of a cam guard apparatus, and more particularly, the present invention is in the technical field of a cam guard apparatus that is mountable on a lower limb of a compound bow to prevent injury to the bow, user and other components on the bow such as the cam.

Compound bows are used in archery for sport and hunting. Though efforts have been made to make the compound bow light and durable, carrying a compound bow for extended periods of time can be tiring. Archers or shooters often have to walk long distances or sit in tree stands or blinds for extended periods of time. As periods of fatigue arise, the archer must be cautious about setting his compound bow on any surface as damage may occur to the cam (or pulley) or the limb of the compound bow. It is important to avoid contact with any surface so that the shooting string does not become contaminated and that the cam is not bent out of alignment. Either of these actions can alter the accuracy and propulsion strength of the compound bow. It is also important to protect the lower cam on a compound bow from anything before, during and after the shot to avoid injury to the bow, shooting string or the shooter.

To cure this problem, several devices have been developed but have their own shortcomings. For example, U.S. Design Pat. No. D530,387 (387 Patent) discloses a large cam guard for use on both limbs of the compound bow. For all practical purposes, the design is too large, heavy and cumbersome to be used on the compound bow as naturally as the compound bow was intended to be used. The large cam guard can be disruptive because of its large size. The cam guard disclosed in U.S. Pat. No. 7,730,833 (833 Patent) is not compatible with the newer compound bows that employ larger and more complex cam systems. For the '833 Patent design to be used on today's compound bows, it would need to be made larger and would be heavy to be placed on a limb to be effective and useful.

Some prior attempts to protect the cam have created unintended consequences such as additional vibration that can affect the accuracy of the compound bow. One example is U.S. Pat. No. 6,216,680 (680 Patent) that discloses a flexible attachment that is used as a cam guard that is affixed on the front end of a lower limb of the compound bow. This flexible attachment is wide and extends downwardly and backwards to hover just below the cam. The shortcoming with this design is that it is affixed to the most flexible part of the limb and is prone to flap around. The cam guard disclosed in U.S. Design Pat. No. D568,435 (435 Patent) also suffers from the same vibration and flapping issue because it is also mounted on the most flexible part of the limb. This design is also noisy when an arrow is shot with it.

Another problem with previous cam guards is that there is not a cam guard on the market that protects the bow and the shooter in the event that the shooting string were to abruptly break when being pulled. If the shooting string were to break, the shooting string rapidly loses tension causing the bow to dry fire that results in the limbs flapping about uncontrollably. Also, there are times when the shooter can cut the string with the broadhead on an arrow. That activity happens when loading an arrow into the bow and cause the bow to dry fire. This action can harm the bow and can harm the shooter.

Thus, there is a need for a cam guard apparatus that protects the cam from coming into contact with a ground surface when the shooter wants to set the bow on the ground surface. The cam guard apparatus should be small and sturdy to prevent vibrations, yet is able to flex slightly. Furthermore the cam guard apparatus should connect to a part of the limb that is less likely to flap and cause vibration. Moreover, there is a need for the cam guard apparatus that minimizes the negative consequences if the shooting string were to break when pulled that can result in harm to the bow and the shooter himself. And there is a need to prevent the bow from dry firing that can also cause harm to the bow and the shooter.

SUMMARY OF THE INVENTION

The above needs are met by the present invention. The cam guard apparatus in the present invention minimizes and nearly eliminates vibrations that would occur on the limb of a bow because the design is small and light weight, yet capable of being firm and sturdy. Furthermore, the cam guard in the present invention connects to a limb end position near the cam so that the limb does not flap around. Moreover, the cam guard apparatus in the present invention is designed to interfere with a draw stop peg to catch the cam from spinning rapidly to a resting position. This interference assists in minimizing the violent flapping that can occur on the limb or limbs if the shooting string were to suddenly break when pulled in a drawn position.

The present cam guard apparatus is designed to be used on a compound bow to protect a cam of the compound bow. Generally, the cam guard apparatus has a C-shaped, rigid support member with a substantially flat connection portion, a concave extension portion, and a substantially flat resting portion. Optionally, a pad is attached to an outer surface of the substantially flat resting portion. A means of securing said C-shaped, rigid support limb to the compound bow is also provided that effectively make the cam guard apparatus one with the compound bow.

DETAILED DESCRIPTION

Figure 1:
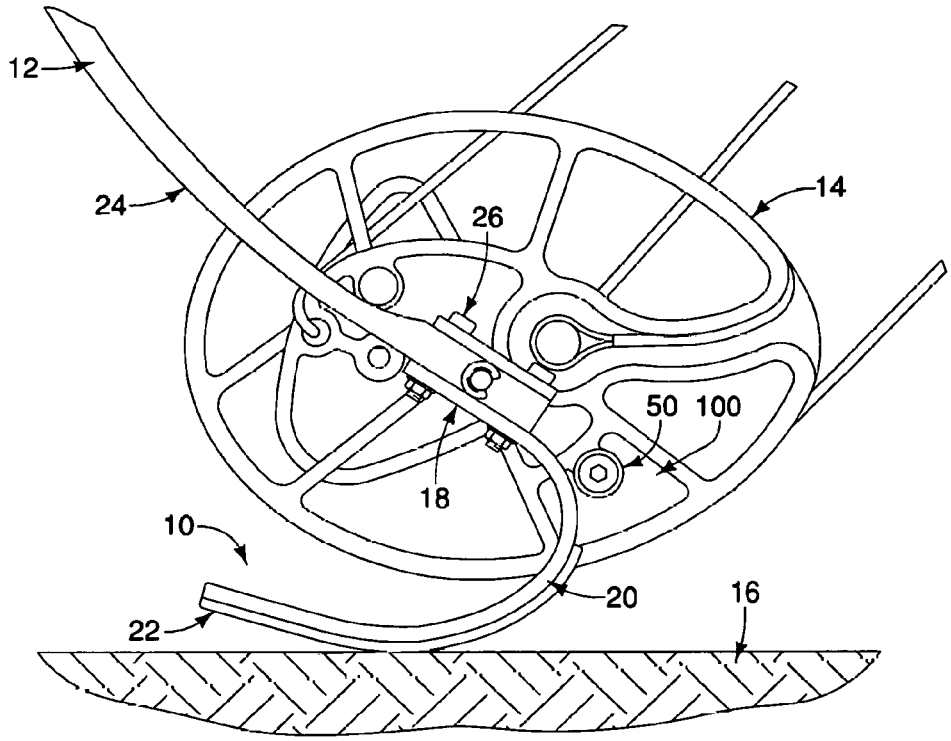
FIG. 1 is a side planar view of a cam guard apparatus with a cam and a draw stop peg shown in a resting position.

Referring to FIG. 1, the present invention is a cam guard apparatus 10. The cam guard apparatus 10 is for use on a compound bow 12 to protect a cam 14 of the compound bow if a shooter carrying the compound bow were to set the compound bow for brief periods on a ground surface 16 to support the weight of the compound bow.

The cam guard apparatus 10 is sturdy and rigid yet has properties to bend. Thus, the material of construction is important. A metal that is capable of being manipulated such as copper, aluminum or steel is preferred, but a hard polymer such as an ABS plastic might also be used. In the most preferred embodiment, ⅛ inch in depth by ½ inch in width aluminum flat stock is used and is bent to shape. However, the width can also be between about 0.2 inches and 2.5 inches in width. The aluminum material assists in preventing rusting and gives the design the right amount of flexibility and rigidness. The shape is substantially C-shaped that is comprised of a substantially flat connection portion 18, a concave extension portion 20, and a substantially flat resting portion 22.

Figure 2:
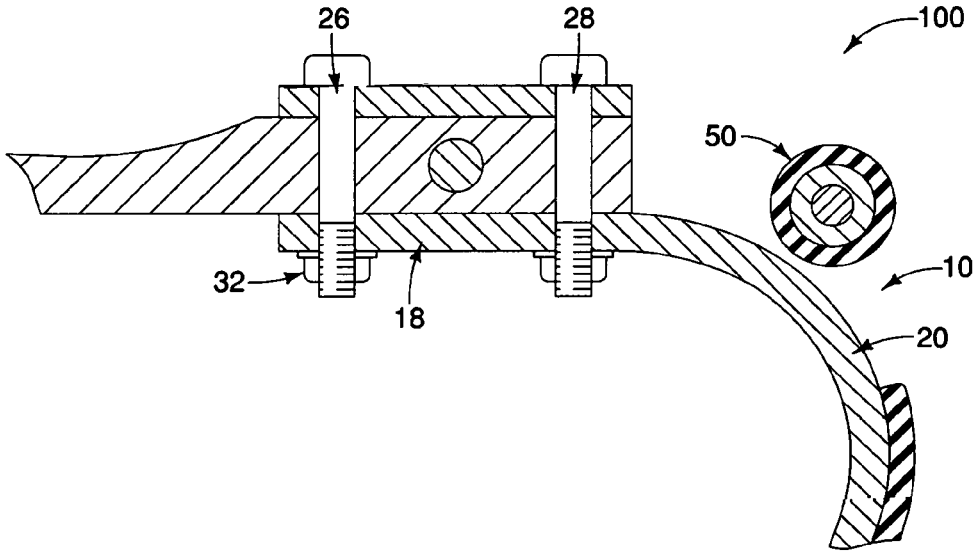
FIG. 2 is a cross-sectional view of the cam guard apparatus connected to the compound bow and the draw stop peg.
Figure 3:
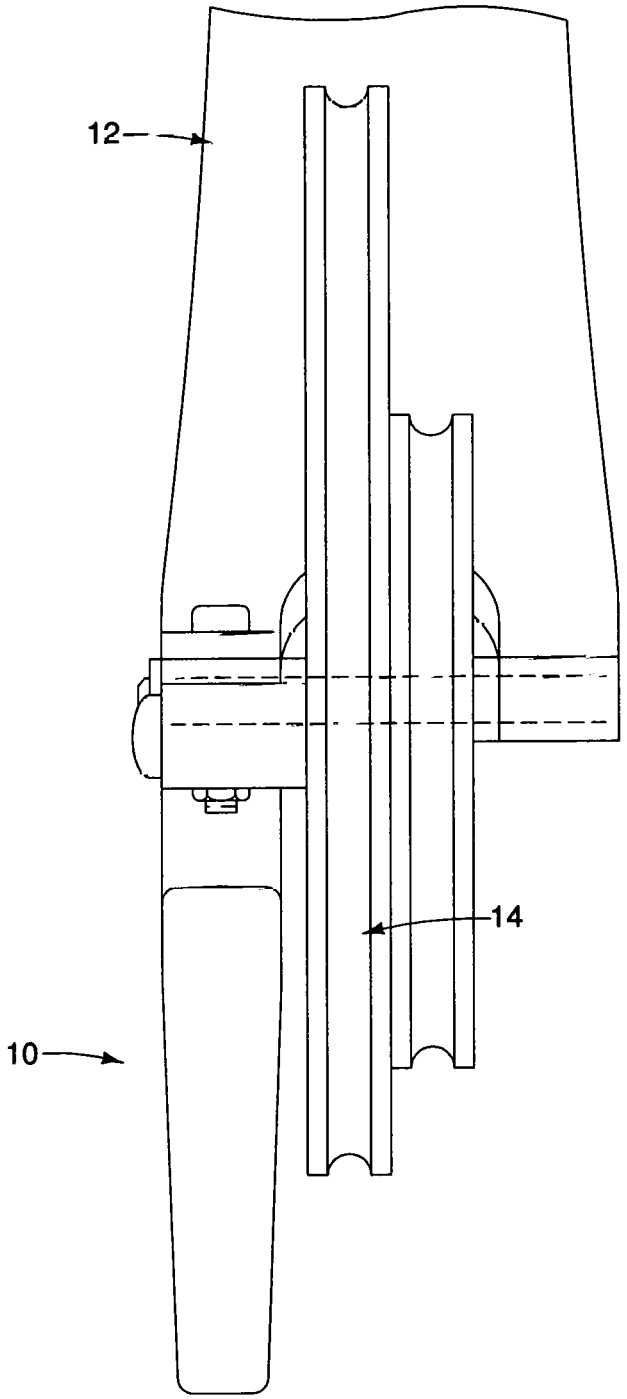
FIG. 3 is a front planar view of the cam guard apparatus and the cam respective to the compound bow.

Now referring to FIGS. 1, 2 and 3, the substantially flat connection portion 18 is provided with a means of securing the substantially flat connection portion to a lower limb 24 of the compound bow. The means of securing the substantially flat connection portion 18 to the lower limb 24 of the compound bow may be provided by an adhesive such as a glue (fluid adhesive) or tape-like material or may be provided by a clamp. The more preferred means of securing the substantially flat connection portion to the lower limb 24 of the compound bow is the use of an at least one nut and bolt assembly 26. This can be shown well in FIG. 2 where two nut and bolt assemblies are utilized to secure the cam guard apparatus 10 to the lower limb 24 in a linear manner and centered relative to the width of the cam guard apparatus 10 (see FIG. 3).

The nut and bolt assembly 26 comprises of a bolt 28 that is of sufficient length to penetrate the depth of the lower limb 24 and the substantially flat connection portion 18. The substantially flat connection portion 18 has a corresponding bolt receiving hole 30 to accommodate the penetration of the bolt 28. A receiving nut 32 then would feed onto a male receiving end of the bolt to secure the cam guard apparatus to the lower limb 24. Optionally, a protective bolt guard is place on an opposing side of the lower limb 24 to protect the lower limb 24 from impressions that the bolt might impose upon the lower limb 24 when the bolt and receiving nut are tightened.

Figure 6:
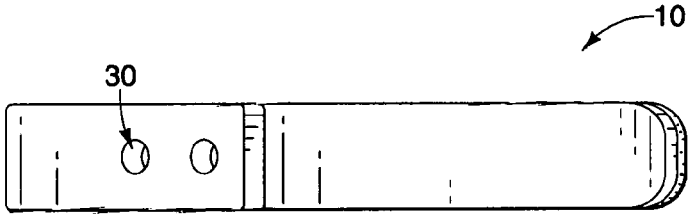
FIG. 6 is a bottom planar view of the cam guard apparatus.

In an optional embodiment and not shown in the figures, the two nut and bolt assemblies may be "off center" and linear respective to the width of the cam guard apparatus. One way to illustrate this concept is to modify the drawing as shown in FIG. 6. In this example, the two corresponding bolt receiving holes would reside in a linear manner but would be positioned slightly above the two corresponding bolt receiving holes shown in FIG. 6. The advantage of this design is that it helps position the cam guard apparatus 10 away from the cam 14 while giving the cam guard apparatus 10 the necessary width for the required durability.

Figure 4:
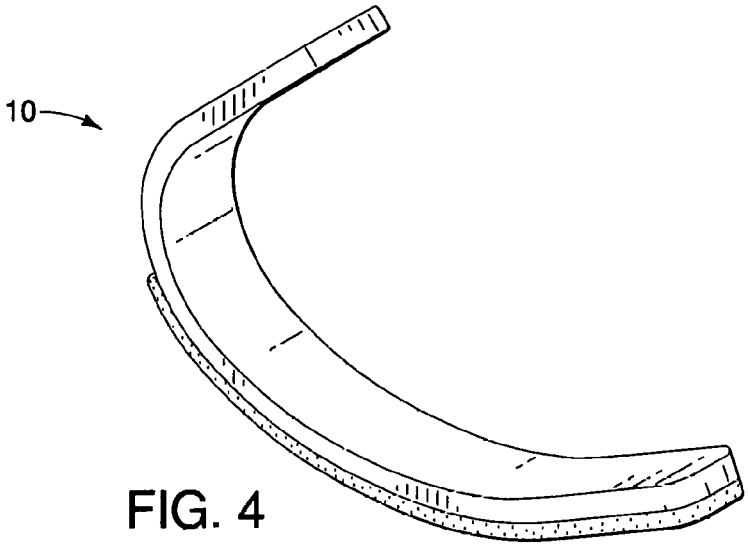
FIG. 4 is a back perspective view of the cam guard apparatus.
Figure 5:
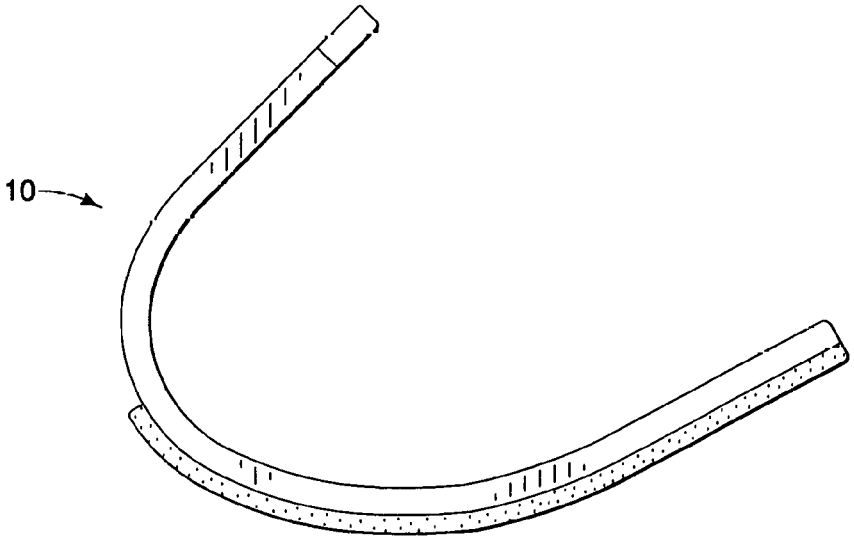
FIG. 5 is a side planar view of an alternative embodiment of the cam guard apparatus that is modified to fit a vertical limb bow.

The concave extension portion 20 is an important part of the cam guard apparatus 10. The concave extension portion 20 extends the substantially flat resting portion 22 to be positioned away from the lower limb 24 when the substantially flat connection portion 18 is secured to the lower limb 24. The concave extension portion 20 also provides the elastic spring in the cam guard apparatus 10 to make the cam guard apparatus 10 durable and comfortable to set on the ground surface. The concave extension portion 20 can be shaped to accommodate a horizontal limb bow as shown in FIG. 1. A horizontal limb bow as known in the art is a bow where the upper limb and the lower limb 24 reside in a substantially parallel manner to the grand surface if fired in a direction linearly and parallel to the ground surface. In this manner, the concave extension portion 20 is provided with a sharper arch so that the substantially flat resting portion 22 resides almost parallel to the substantially flat connection portion. Optionally, the concave extension portion 20 can be shaped to accommodate a vertical limb bow as shown in FIGS. 4 and 5. In this manner, the concave extension portion 20 is provided with a more gradual arch so that the substantially flat resting portion 22 resides in an acute angel relative to the substantially flat connection portion 18. In either embodiment, the concave extension portion 20 should allow the shooter to rest the compound bow in an upright position where the substantially flat resting portion 22 is parallel to the ground surface and this is enabled by the angel of the concave extension portion.

Another important feature of the present invention is that the concave extension portion 20 resides in a position to come into contact with a draw stop peg 50 as shown in FIGS. 1 and 2 if a draw stop peg 50 is provided on the cam 14. As such, the draw stop pen 50 may come into contact with the concave extension portion 20 when the compound bow is in operation, such as when the bow string is pulled or when the bow string is released and a failure occurs. The draw stop peg 50 is attached to the cam 14 to inform the shooter that he has reached the end of his draw. When the shooting string of the compound bow is drawn, the draw stop peg 50 is moved rotationally and eventually butts against the opposing side of the lower limb 24 to where the shooting string cannot be drawn back any further. When the shooter is ready to release the shooting string, the cam 14 rotates rapidly causing the draw stop peg 50 to rotate violently with the cam 14. If the shooting string were to break, the cam 14 would continue to rotate causing the limbs of the compound bow to shake violently. However, the present cam guard apparatus is positioned such that the concave extension portion 20 disrupts the continued rotation of the cam 14 by interfering with this motion of the draw stop peg 50 if the shooting string were to break. This disruption provides an important safety feature that does not exist on other cam guards.

The substantially flat resting portion 22 is positioned below the substantially flat connection portion 18. The substantially flat resting portion 22 is of sufficient length to provide support for the compound bow on the ground surface. The support should substantially balance the weight of the compound bow in an upright position with little effort by the shooter other than to keep the compound bow from tipping over. Thus, the force required by the shooter to keep the compound bow and the corresponding lower cam 14 from coming into contact with the ground surface would be to prevent a top portion of the bow from moving in a planar direction relative to the ground surface. As shown in FIGS. 4 and 6, an end point of the substantially flat resting portion 22 is preferably rounded at an end point 25 to assist in preventing clothing or skin to get caught on the cam guard apparatus. However, it may be noted that a squared edge or tapered edge may be used at the end point.

In an optional embodiment, the substantially flat resting portion 22 is further provided with a pad 34 attached to an outer surface 36 of the substantially flat resting portion 22. The outer surface generally faces the ground surface when the cam guard apparatus is at rest on the ground surface. The pad adds additional shock absorption properties. Furthermore, the pad assists to prevent slippage of the cam guard apparatus on the ground surface if the compound bow were to be rested on a wet stone, wood or metal. The pad is also used to assist in preventing scratches and other injuries to the substantially flat resting portion 22. The pad is preferably adhered to the outer surface of the substantially flat resting portion 22 by an adhesive fluid like a glue or optionally, the pad may be taped, bolted or melted on the outer surface. The pad itself is preferably made of a rubber material as rubber has general traction, shock absorption and shape manipulation properties; however, other soft materials may be used such as a polymer based material, felt, animal skin or cloth. Types of polymer based materials that might be employed may include soft plastics such as thermoplastic elastomer products. The advantage of these types of rubbers and polymers is that additional grip designs may be employed to better catch the ground surface such as a traction design or customized name or logo. The pad 34 is preferably ⅛ to 2 times the width of the C-shaped, rigid support member. The pad 34 preferably covers a majority of the entire area of the substantially flat resting portion 22 but it may optional cover a smaller surface area of the substantially flat resting portion 22 such as ¼ of its surface area.

A cam guard system 100 as shown in FIGS. 1 and 2 is also provided by the present invention that employs the cam guard apparatus 10 in combination with the compound bow that is provided with the draw stop peg 50 on the outside surface of the cam 14. An important feature of the cam guard system 100 is to protect the shooter and the compound bow if the shooting string were to break when pulled. The cam guard system 100 requires the concave extension portion 20 to interfere with the draw stop peg 50 in the event that the shooting string were to break so that the rotation on the cam 14 is stopped and prevented from advancing to the lower limb 24 of the compound bow. By preventing this continuous rotation, the lower limb 24 will not shake violently in the event of a string failure. An upper limb and the compound bow itself will not shake violently and the user will be spared from injury by preventing this violent response.

The narrow design of the cam guard apparatus 10 gives the cam guard apparatus 10 the ability to reside proximate to the cam 14 in a planar relationship. The planar relationship is defined as the cam 14 and the cam guard apparatus 10 creating parallel planes whereby less than 6 inches but greater than 0.1 inches separate the parallel planes that exist between a near edge of the cam 40 and a near edge of the cam guard apparatus 38 as shown in FIG. 3. In the most preferred embodiment, approximately 3 inches separate the closest planes of the cam guard apparatus 10 and the cam 14.

While a particular embodiment of the cam guard apparatus has been described herein, it will be appreciated by those skilled in the art that changes and modifications may be made thereto without departing from the invention in its broader aspects and as set forth herein.

I claim:

1. A cam guard system that employs a cam guard apparatus for use on a compound bow to protect a cam of the compound bow, wherein said cam guard apparatus comprises:

A C-shaped, rigid support member with a substantially flat connection portion, a concave extension portion, and a substantially flat resting portion;

a means of securing said substantially flat connection portion to the compound bow; and a draw stop peg on an outside surface of the cam that resides in an operational relationship with said C-shaped, rigid support member.

2. The cam guard system of claim 1, wherein said C-shaped, rigid support member is in a position to come into contact with said draw stop peg when the compound bow is in operation.

3. The cam guard system of claim 2, wherein said C-shaped, rigid support member resides proximate to the cam in a planar relationship and said C-shaped, rigid support member and a parallel plane of a near edge of the cam is separated by 0.1 inches and 6 inches in a lateral direction from a parallel plane of a near edge of the C-shaped, rigid support member.

4. The cam guard system of claim 3, further comprising a pad attached to an outer surface of said substantially flat resting portion.

5. The cam guard system of claim 4, wherein said means of securing said substantially flat connection portion to the compound bow is provided by an at least one nut and bolt assembly.

6. A cam guard system that employs a cam guard apparatus for use on a compound bow to protect a cam of the compound bow, wherein said cam guard apparatus comprises:

A C-shaped, rigid support member with a substantially flat connection portion, a concave extension portion, and a substantially flat resting portion;

A pad attached to an outer surface of said substantially flat resting portion;

a means of securing said substantially flat connection portion to the compound bow; and a draw stop peg on an outside surface of the cam that resides in an operational relationship with said C-shaped, rigid support member.

* * * * *